US006504561B1

(12) United States Patent
Yih

(10) Patent No.: US 6,504,561 B1
(45) Date of Patent: Jan. 7, 2003

(54) THERMAL COLOR PRINTER

(75) Inventor: Yung Yih, Taipei (TW)

(73) Assignee: Acer Communications & Multimedia Inc., Yaoyuan (TW)

( * ) Notice: Subject to any disclaimer, the term of this patent is extended or adjusted under 35 U.S.C. 154(b) by 0 days.

(21) Appl. No.: 09/638,918

(22) Filed: Aug. 16, 2000

(30) Foreign Application Priority Data

Oct. 21, 1999 (TW) ..... 88118249 A

(51) Int. Cl.[7] ..... B41J 2/325; B41J 33/00; B41J 35/16

(52) U.S. Cl. ..... 347/173

(58) Field of Search ..... 347/173, 171, 347/176, 178, 217; 400/120.02, 120.07, 120.03, 120.04, 240, 240.3, 240.4, 237, 239, 615.2

(56) References Cited

U.S. PATENT DOCUMENTS

| | | | | |
|---|---|---|---|---|
| 4,573,059 A | * | 2/1986 | Shinma et al. | 347/178 |
| 4,710,781 A | | 12/1987 | Stephenson | |
| RE33,260 E | | 7/1990 | Stephenson | |
| 5,037,218 A | | 8/1991 | Shimizu et al. | |
| 5,466,075 A | * | 11/1995 | Kouzai et al. | 400/240.3 |
| 5,478,157 A | * | 12/1995 | Kohno et al. | 400/120.02 |
| 5,751,601 A | | 5/1998 | Tang et al. | |
| 5,769,549 A | * | 6/1998 | Kouzai et al | 400/240.4 |
| 5,781,219 A | * | 7/1998 | Kouzai et al. | 347/178 |
| 5,820,274 A | * | 10/1998 | Fukuoka et al. | 400/120.02 |
| 5,829,897 A | * | 11/1998 | Murai | 400/615.2 |
| 5,853,255 A | * | 12/1998 | Soshi et al. | 400/237 |
| 6,071,024 A | | 6/2000 | Chi-Ming et al. | |
| 6,080,993 A | | 6/2000 | Zwijsen | |
| 6,121,987 A | * | 9/2000 | Sasaki et al. | 347/176 |

FOREIGN PATENT DOCUMENTS

| | | |
|---|---|---|
| JP | 60-96473 | 5/1985 |
| JP | 60-154093 | 8/1985 |
| JP | 63-41177 | 2/1988 |
| JP | 11-180016 | 7/1999 |

* cited by examiner

*Primary Examiner*—John S. Hilten
*Assistant Examiner*—K. Feggins
(74) *Attorney, Agent, or Firm*—Rabin & Berdo, P.C.

(57) ABSTRACT

A thermal printer using colorful rays and infrared rays for identifying colorant regions of an ink sheet is provided. The ink sheet includes a number of colorant region sets. Each colorant region set includes a yellow region, a magenta region, a cyan region and a black mark arranged at the beginning of the cyan region. The black mark is infrared ray non-transmittable. The thermal printer further includes an infrared ray source/an infrared ray sensor for sensing the black mark, and a blue ray source/a blue ray sensor (or an amber ray source/an amber ray sensor) for sensing the colorant regions.

6 Claims, 9 Drawing Sheets

THERMAL COLOR PRINTER

BACKGROUND OF THE INVENTION

This application incorporates by reference Taiwanese application Serial No. 88118249, Filed Oct. 21, 1999.

1. Field of the Invention

The invention relates in general to a thermal color printer, and more particularly to a thermal color printer using infrared ray with amber ray, or infrared ray with blue ray for identifying different colorant regions on an ink sheet.

2. Description of the Relative Art

Printers are commonly used for current computer users to print out data, like text data and colorful drawings. Theses colorful drawings could be an image downloaded from Internet or pictures captured by digital cameras.

Dot-impact printer, ink jet printer, laserjet printer, and thermal printer are examples of the most popular printers.

Whereas, there are two types of thermal printers: dye-sublimation printers and thermal wax printers. Different dyes or colorants in respective colorant regions of the ink sheet are printed onto print medium such as paper by ways of thermal-sublimation or thermal-transfer. Hence, dyes and colorant for a thermal printer should be thermally transferable. In other words, they can be printed onto print mediums when they are heated.

Ink sheet generally includes many colorant region sets, and each includes three colorant regions: a yellow (Y) region, a magenta (M) region and a cyan (C) region. Colorant region sets of certain ink sheets further include a black (K) region or/and an overlay (O) region. Herein, region Y, region M, region C, region K and region O respectively represent to the yellow region, the magenta region, the cyan region, the black region and the overlay region for simplicity. A black image formed from region K is usually with better quality than the one formed by mixing the YMC colorants. Region O, which is the so-called over-coating region, is used to protect other already printed colorants by forming a protective coating on the surface of the print medium.

It is an important subject for a thermal printer to precisely distinguish different colorant regions and print correct colorant onto print medium. Conventional techniques related to methods of identifying colorant region are disclosed in, for example, U.S. Pat. Nos. 4,496,955, 4,710,781, and 5,781,219.

Taking U.S. Pat. No. 5,781,219 as an example, the head sensor mark and the identification sensor mark are used to identify colorant regions on the ink sheet. In the first embodiment of the U.S. Pat. No. 5,781,219, the ink sheet includes region Y, region M, region C and region K. One side of the ink sheet further includes transparent parts. The head sensor mark is arranged on the transparent parts between region Y and region K. The identification sensor mark is arranged between region Y and region C.

The disadvantage of the technique according to U.S. Pat. No. 5,781,219 is stated as follows. If there is no enough distance between region C and region K, the sensors may not be able to correctly sense the beginning of region K, which causes misallocation. Increasing the distance between region C and region K is the common solution for misallocation, which however also increases the length of ink sheet. An ink sheet of larger length is of course of higher cost, which is not desirable. Similarly, in the fourth embodiment of U.S. Pat. No. 5,781,219, the identification sensor mark is arranged between region M and region C. There must be enough distance between region M and the identification sensor mark to correctly sense the identification sensor mark.

SUMMARY OF THE INVENTION

It is therefore an object of the invention to provide an improved thermal printer using colorful rays and infrared rays for colorant region identification with the auxiliary of black marks. Black marks are arranged between predetermined colorant regions, instead of being arranged at transparent parts. Therefore, the ink sheet is shorter than the conventional ones.

The invention achieves the above-identified objects by providing a new thermal printer, including an ink sheet, a printing head, a forwarding device, the first ray source and the first sensor and the second ray source and the second sensor. The ink sheet includes a yellow region, a magenta region, a cyan region, and a first mark. The three regions are arranged sequentially and the first mark is arranged at the beginning of the cyan region. The printing head is for printing colorants of the colorant regions onto a print medium. The forwarding device forwards the ink sheet to have a relative movement to the printing head. The first ray source and the first sensor detect the first mark and send out the first signal. The second ray source and the second sensor detect the colorant regions and send out a second signal. When the forwarding device forwards the ink sheet, which colorant region the printing head locates is determined by the first signal and the second signal.

It is therefore a further object to provide an ink sheet of a thermal printer. The location of each colorant region is identified by the first ray source and the second ray source. The ink sheet includes a yellow region, a magenta region and a cyan region, which are sequentially arranged on the ink sheet. The ink sheet further includes the first mark. The first mark is arranged at the beginning of the cyan region. The first ray emitted by the first ray source transmits through the yellow region, the magenta region and the cyan region. The first ray and the second ray emitted by the first and the second ray sources could not transmit through the first mark.

It is therefore another subject of the invention that a printing method of a thermal printer is disclosed. The thermal printer includes an ink sheet, an infrared ray source, an infrared ray sensor, an amber ray source, and an amber ray sensor. A yellow region, a magenta region, a cyan region and an overlay region are sequentially arranged on the ink sheet. The first and the second marks are respectively arranged at the beginning of the yellow region and the beginning of the cyan region. The first mark and the second mark are not transmitted by infrared ray and amber ray. The printing method includes the following steps. The ink sheet is first forwarded. Then, the process of forwarding the ink sheet is stopped and the colorant of the yellow region begins to be printed onto a print medium when the amber ray is sensed and the infrared ray is not sensed. In the process of printing, IR ray is not always shades. Next, the ink sheet is forwarded until amber ray is not sensed. After the forwarding of the ink sheet is stopped, colorant of the magenta region is printed onto the print medium. Then, the ink sheet is forwarded again until the infrared ray is not sensed. Colorant of the cyan region is then printed. Next, the ink sheet is forwarded until amber ray is sensed. Colorant of the overlay region is then printed.

It is therefore a further object of the invention to provide a printing method of a thermal printer. The thermal printer includes an ink sheet, an infrared ray source, an infrared ray sensor, an amber ray source, and an amber ray sensor. The ink sheet is sequentially arranged with a yellow region, a magenta region and a cyan region. The first mark is arranged at the beginning of the cyan region and the first mark can not be transmitted by the infrared ray and the amber ray. The printing method includes the following steps. The ink sheet is first forwarded and then stopped while the sensing result of amber ray is changed from low to high. Next, colorant of the yellow region is printed onto the print medium. The ink sheet is forwarded again until the sensing result of amber ray is low. Then the ink sheet is stopped and colorant of the magenta region is printed onto the print medium. The ink sheet is again forwarded until the sensing result of infrared ray is low. Next, the ink sheet is stopped and colorant of the cyan region is printed onto the print medium.

It is therefore a further object of the invention to provide a printing method of a thermal printer. The thermal printer includes an ink sheet, an infrared ray source, an infrared ray sensor, a blue ray source, and a blue ray sensor. The ink sheet sequentially includes a yellow region, a magenta region and a cyan region. The first mark, which is infrared ray and blue ray non-transmittable, is arranged at the beginning of the cyan region. The printing method includes the following steps. The ink sheet is forwarded until the sensing result of blue ray is from high to low. Then, the ink sheet is stopped and colorant of the yellow region is printed onto a print medium. The ink sheet is again forwarded until the sensing result of blue ray is high. The ink sheet is then stopped and colorant of the magenta region is printed onto the print medium. The ink sheet is next forwarded until the sensing result of infrared ray low. After the ink sheet is stopped, colorant of the cyan region is printed.

It is therefore a further object of the invention to provide a printing method of a thermal printer. The thermal printer includes an ink sheet, an infrared ray source, an infrared ray sensor, a blue ray source, and a blue ray sensor. The ink sheet sequentially includes a yellow region, a magenta region, a cyan region and a black mark. The first mark and the second mark are respectively arranged at the beginning of the yellow region and the beginning of the cyan region. The first mark and the second mark are both infrared ray and blue ray non-transmittable. The printing method includes the following steps. The ink sheet is first forwarded until the sensing result of blue ray is low and the sensing result of infrared ray is low. The forwarding of the ink sheet is then stopped and colorant of the yellow region is printed onto a print medium. The ink sheet is then forwarded until the sensing result of blue ray is high. After the ink sheet is stopped, colorant of the magenta is printed onto the print medium. The ink sheet is again forwarded until the sensing result of infrared ray is low. After the ink sheet is stopped colorant of the cyan region is printed onto the print medium. Next, the ink sheet is forwarded until the sensing result of blue ray is low. After the forwarding of the ink sheet is stopped, colorant of the overlay region is printed onto the print medium.

BRIEF DESCRIPTION OF THE DRAWINGS

Other objects, features, and advantages of the invention will become apparent from the following detailed description of the preferred but non-limiting examples. The description is made with reference to the accompanying drawings, in which.

DESCRIPTION OF THE PREFERRED EMBODIMENT

Figure 1:
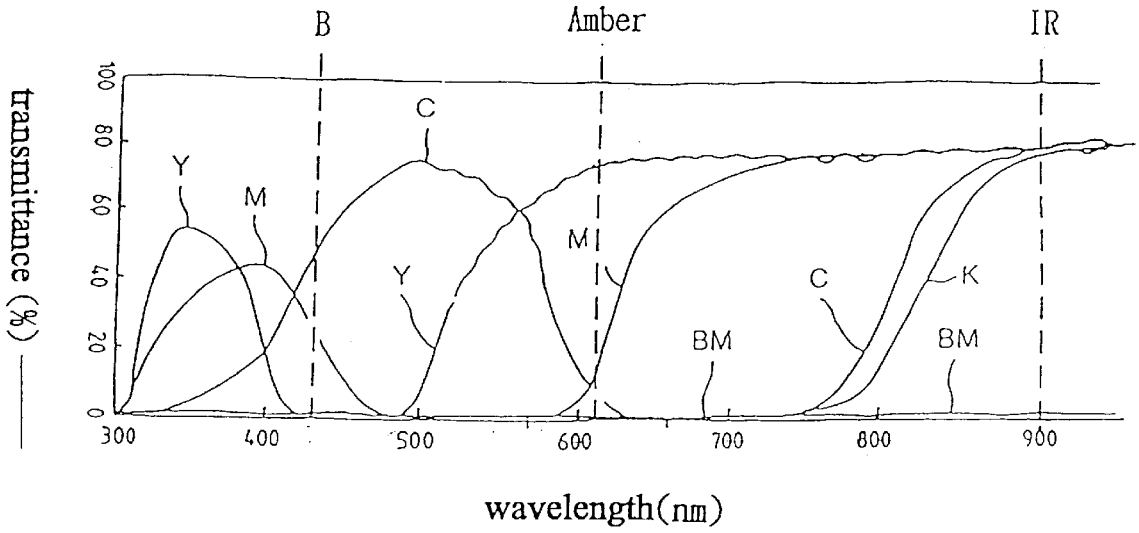
FIG. 1 shows a spectrum diagram of colorants and colorful rays.

Now referring to FIG. 1, which shows a spectrum diagram of colorants and colorful rays applied in the invention. In FIG. 1, the horizontal axis, in nm, shows wavelength; and the vertical axis, in percent (%), shows transmittance. The vertical dotted lines indicated by the symbols "B", "Amber" and "IR" respectively represent the wavelength of blue ray, amber ray and infrared (IR) ray. The curves Y, M, C, K and BM respectively represent the spectrum of colorants Y, M, C, K and black-mark (BM).

Amber ray has a wavelength of about 610 nm, and transmits through colorant Y, but not colorant regions M, C, BM and K. Blue ray has a wavelength of about 430 nm, and transmits through colorant regions M and C, but not colorant regions Y, BM and K. IR ray has a wavelength of about 900 nm, and transmits through colorant regions Y, M, C, BM and K. Although not shown in FIG. 1, all these three rays transmit through colorant region O.

The ray transmittance of each colorant is shown in Table 1.

TABLE 1

| Colorant/ray | Amber | Blue | IR |
|---|---|---|---|
| Y | 1 | 0 | 1 |
| M | 0 | 1 | 1 |
| C | 0 | 1 | 1 |
| K | 0 | 0 | 1 |
| O | 1 | 1 | 1 |
| BM | 0 | 0 | 0 |

In Table 1, symbol "1" represents that the certain colorant region can be transmitted through by the designated ray. Thus, the transmitted ray can be sensed by sensors. Symbol "0" represents that the certain colorant region can not be transmitted through by the designated ray and the ray is not sensed. According to Table 1, amber ray transmits through colorant regions Y and O, but not through colorant regions M, C, K and BM. Blue ray transmits through colorant regions M, C and O, but not through colorant regions Y, K and BM. IR ray can transmit through colorant regions Y, M, C, K and O, but not through colorant region BM.

Although colorant region BM and colorant region K are both black, the composition of the colorant of these two regions are different from each other. The composition of colorant K makes it IR ray transmittable. However, IR ray can not transmit through colorant region BM. Of course, colorant BM with any composition, which makes colorant region BM IR ray non-transmittable, can be applied herein and is therefore within the scope of the invention.

THE FIRST EXAMPLE

Figure 3:
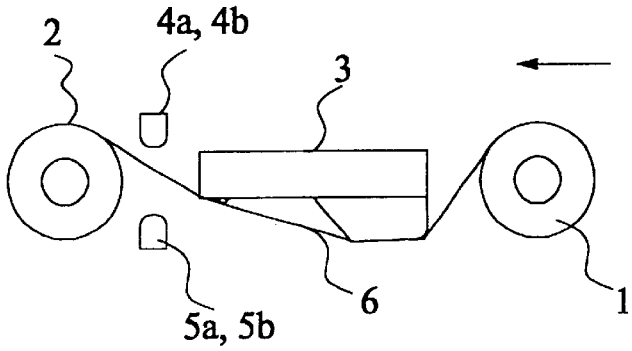
FIG. 3 shows a lateral view of the main structure of the thermal printer according to the first example of the invention.
Figure 2:
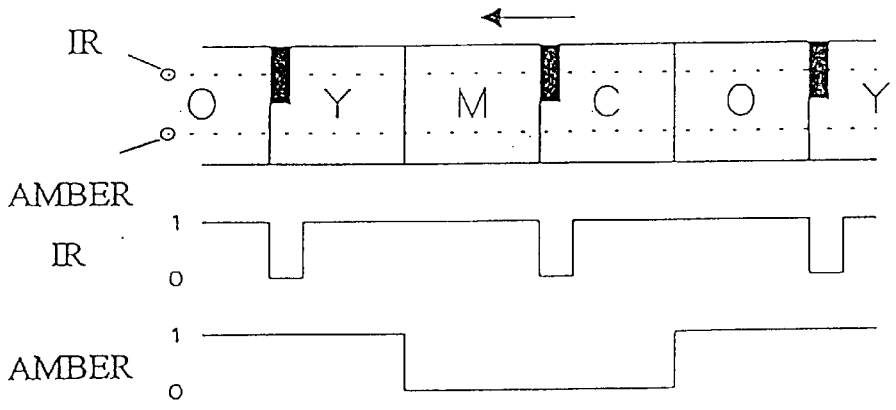
FIG. 2 shows the structure of the ink sheet according to the first example of the invention.

FIG. 2 shows the structure of the ink sheet according to the first example of the invention. FIG. 3 shows the main structure of the thermal printer according to the first example of the invention. In FIGS. 2 and 3, the arrows indicate the forwarding direction of the ink sheet during printing. In FIG. 2, there are two dotted lines, a upper one and a lower one. The upper dotted line indicates the relative location of the IR ray source and the IR ray sensor to the ink sheet when the ink sheet is forwarded. Similarly, the lower dotted line indicates the relative location of the amber ray source and the amber ray sensor to the ink sheet when the ink sheet is forwarded.

As shown in FIG. 2, each colorant region set of the ink sheet includes region Y, region M, region C and region O. The printing order for each colorant region set is region Y, region M, region C and then region O. In other words, region Y is the first colorant region to be printed, and region O is the last one.

According to the first example of the invention, amber ray together with IR ray is applied to identify the location of colorant regions. From Table 1, it is known that amber ray can transmit through region Y and O, but not region M , BM and C. Amber ray transmits through region Y and then reach amber ray sensor so that amber ray is sensed when the sensor is in region Y. In the case that amber ray is sensed, a sensing result of amber ray is high. On the other hand, amber ray can not transmit through region M so that amber ray is not sensed when the sensor is in region M. In the case that amber ray is not sensed, the sensing result of amber ray is low. When the sensor moves from region Y (amber ray transmittable) to region M (amber ray non-transmittable), the sensing result changes from high to low. To sum up, region Y and region M are distinguishable by amber ray. Similarly, region C and region O are distinguishable by amber ray. However, region Y and region O are not distinguishable by amber ray because they are both amber ray transmittable. Also, region M and region C are not distinguishable by amber ray because they are neither non-transmittable.

According to the first example of the invention, a black mark is designed between two adjacent colorant regions which are amber ray non-disguishable. Consequently, both the beginning of region Y and region C are arranged with black marks.

By using IR ray and amber ray to identify colorant regions, two relationship lines in FIG. 2 are obtained. The two relationship lines respectively represent IR ray transmittance and amber ray transmittance of the colorant regions of the ink sheet according to the first example of the invention.

FIG. 3 is the lateral view of the main structure of the thermal printer according to the first example of the invention. New ink sheets 6 are supplied by an ink-sheet supplier 1 and the used ink sheets 6 are then collected by an ink-sheet collector 2. Colorant or dye of the colorant region is printed onto the predetermined area of the print medium, using a printing head 3, preferably by dye-sublimation or wax-transfer. Amber ray is emitted from an amber ray source 4*a* and sensed by an amber ray sensor 5*a*. In FIG. 3, there are the IR ray source 4*b* and the IR ray sensor 5*b*. The IR ray source 4*b* is at the same position with the amber ray source 4*a* on Y-axis direction. The IR ray sensor 5*b* is at the same position with the amber ray sensor 5*b* on Y-axis direction. IR ray is emitted from the IR ray source 4*b* and sensed by the IR ray sensor 5*b*.

The thermal printer further includes a forwarding device (not shown). The forwarding device forwards the ink sheet 6 to have a relative movement to the printing head 3. The relative movement is stopped while the printing head is located at desired colorant region. Wherein, the cease of the relative movement is determined by the amber ray sensor and the IR ray sensor.

Figure 4:
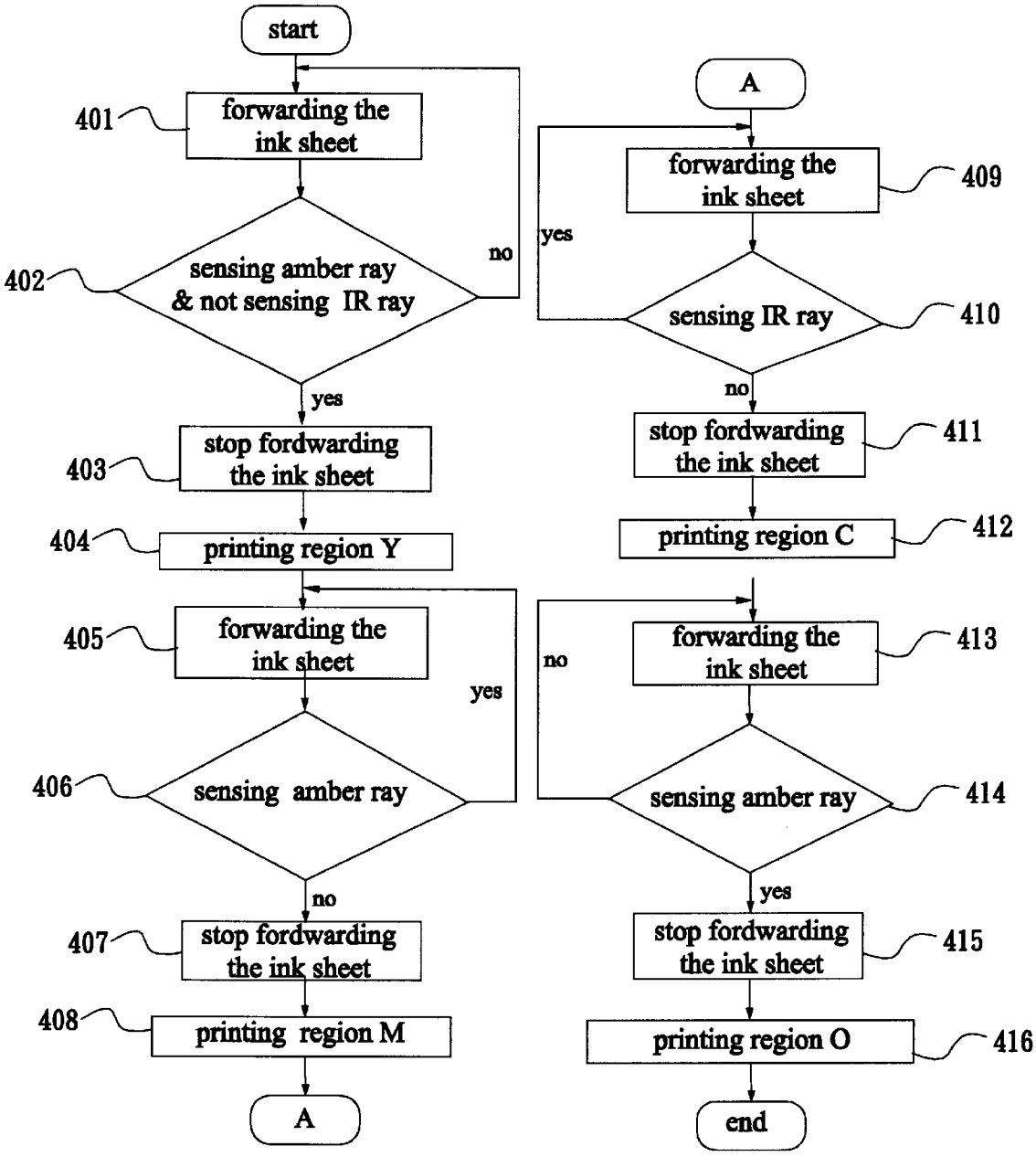
FIG. 4 is a flow chart showing the printing procedure according to the first example of the invention.

FIG. 4 shows the printing procedure according to the first example of the invention. First, as shown in step 401, the ink sheet is forwarded so that region Y, region M, region C and region O are sequentially passed through the sensors. Therefore, in the order of Y, M, C and O, desired colorants or dye at the colorant regions are printed onto the print medium. It is important to precisely identify the beginning of a new region Y The identification of region Y is determined by the sense of amber ray but no detection of IR ray transmittance. While amber ray is sensed and no IR ray is sensed (step 402), which means region Y is identified, the forwarding of the ink sheet is stopped as shown in step 403. If region Y can not be identified, the ink sheet is kept forwarding, as shown in step 401.

After step 403, when the ink sheet forwarding procedure is stopped, colorant or dye at region Y is printed onto desired location of the print medium, as shown in step 404. The colorant or dye is printed preferably by ways of dye-sublimation or wax-transfer.

After colorant or dye at region Y is printed, the ink sheet is forwarded again, as shown in step 405.

In the following steps, region M is to be identified. Since amber ray transmits through only region Y but not region M, the identification of region M can be decided by the non-detecting of amber ray. Therefore, the ink sheet is kept forwarding, as shown in step 405, until no transmittance of amber ray is sensed. In step 406, whether amber ray is sensed or not is determined. Once amber ray is not sensed, which means region M is identified, the ink sheet forwarding procedure is stopped as shown is step 407. However, if amber ray is still sensed, the ink sheet will be kept forwarding as shown in step 405.

After region M is identified and the forwarding of ink sheet is stopped, the colorant or dye at region M is printed onto desired location of the printed medium as shown in step 408. The colorant or dye is preferably printed by ways of dye-sublimation or wax-transfer. After that, the ink sheet is forwarded again, as shown in step 409.

Then, region C is to be identified. The character that amber ray transmits neither through region M nor through region C is applied. According to the first example of the invention, a black mark, which is detected by IR ray, is designed between two adjacent regions M and C. In step 410, it is determined whether IR ray is sensed or not. If IR ray is not sensed, which means region C is identified, the forwarding of the ink sheet is stopped as shown in step 411.

However, if IR ray is still sensed, the ink sheet will be kept forwarding as shown in step 409.

After region C is identified and the forwarding of ink sheet is stopped, the colorant or dye at region C is printed onto the desired area of the printed medium as shown in step 412. The colorant or dye is preferably printed by ways of dye-sublimation or wax-transfer. After that, the ink sheet is forwarded again, as shown in step 413.

Then, region O ("the" region O) is to be identified. It is known that region O is amber ray transmittable but region C is not amber ray transmittable. After region C is identified, it is determined whether amber ray is sensed or not, as shown in step 414. If amber ray is sensed, which means region O is identified, the forwarding procedure of the ink sheet will be ceased as shown in step 415. However, if amber ray is not sensed, the ink sheet will be kept forwarding as shown in step 413. The procedure of ink sheet forwarding will be continued until amber ray is sensed.

After region O is identified and the forwarding of ink sheet is stopped, the colorant or dye at region O is printed, preferably by ways of dye-sublimation or wax-transfer, onto desired location of the printed medium, as shown in step 416. By now, the printing procedure of one set of colorant regions is completed.

The printing procedure of the thermal printer according to the first preferred example of the invention is summarized. After region Y is identified, the ink sheet 6 is stopped from forwarding; and the printing head 3 prints colorant Y onto the print medium. After colorant Y is printed, the ink sheet 6 is forwarded again in order to identify region M. After region M is identified, the ink sheet 6 is stopped from forwarding and the printing head 3 prints colorant M onto the print medium. After colorant M is printed, the ink sheet 6 is forwarded again in order to identify region C. After region C is identified, the ink sheet 6 is stopped from forwarding and the printing head 3 prints colorant C onto the print medium. After colorant C is printed, the ink sheet 6 is forwarded again in order to identify region O. After region O is identified, the ink sheet 6 is stopped from forwarding and the printing head 3 prints colorant O onto the print medium. The thermal printer by now completes the printing procedure of one colorant region set in the cyclic order of region Y, region M, region C and region O.

THE SECOND EXAMPLE

Figure 5:
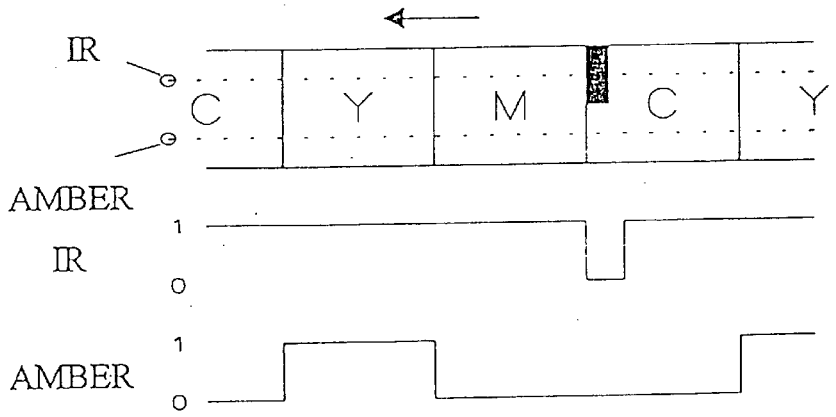
FIG. 5 shows the structure of the ink sheet according to the second example of the invention.

Referring to FIG. 5, the structure of the ink sheet according to the second example of the invention is shown. The arrows indicate the forwarding direction of the ink sheet when the thermal printer performs the printing procedure. In FIG. 5, the upper dotted line indicates the relative location of the IR ray source and the IR ray sensor to the ink sheet when the ink sheet is forwarded. The lower dotted line indicates the relative location of the amber ray source and the amber ray sensor to the ink sheet when the ink sheet is forwarded.

According to the second preferred example of the invention, each colorant region set of the ink sheet includes region Y, region M and region C, as shown in FIG. 5. The printing order is region Y, region M and region C. In other words, region Y is the first colorant region to be printed in each colorant region set, and region C is the last one.

The location of each colorant region is identified by using amber ray and IR ray. From Table 1, it is known that the amber ray transmits through region Y but not region M and region C. Since region M and region C are both amber ray non-transmittable, they can not be distinguished from each other by only using amber ray. According to the second example of the invention, a black mark is designed between two adjacent colorant regions M and C that amber ray can not identify and IR ray is applied to identify the black mark. The black mark is designed at the beginning position of region C. By using IR ray to identify the black mark and amber ray to identify colorant regions Y, M and C, the three colorants can be distinguished from each other.

By using IR ray to identify the black and using amber ray to identify colorant regions, two relationship lines in FIG. 5 are obtained. The two relationship lines respectively represent IR ray transmittance and amber ray transmittance of the colorant regions.

The thermal printer applied in the second example has a structure similar to the one applied in the first example, except that it has an ink sheet consisting of only three colorant regions, which are region Y, region M and region C.

Figure 6:
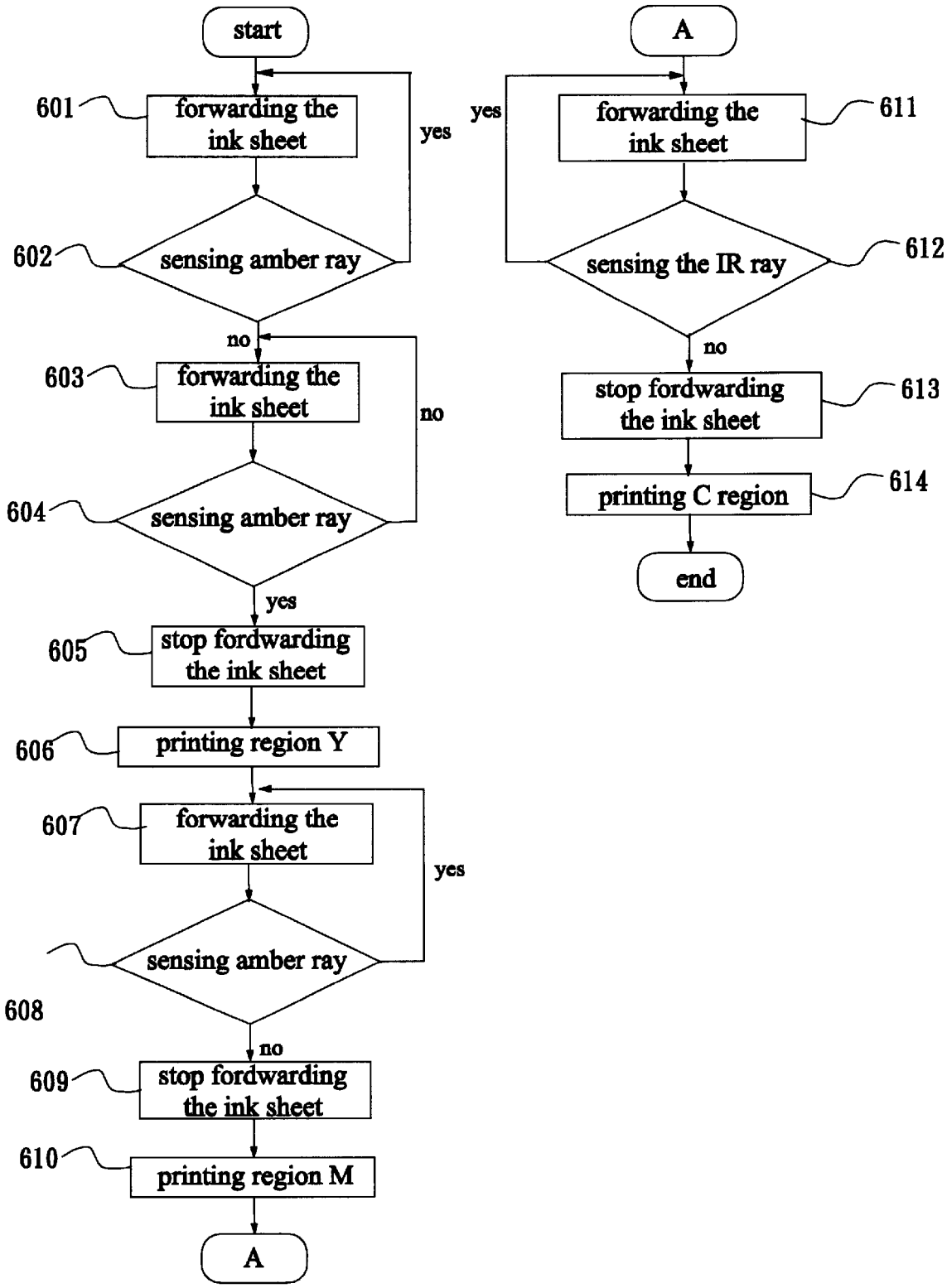
FIG. 6 is a flow chart showing the printing procedure according to the second example of the invention.

FIG. 6 shows the steps of printing one colorant region set with colorant region Y, colorant region M and colorant region C according to the second example of the invention.

First, as shown in the step 601, the ink sheet is forwarded in a certain direction so that region Y, region M and region C are sequentially passed through the IR ray sensor and the amber ray sensor.

According to the second example of the invention, colorants at the ink sheet are printed onto the print medium in the sequence of region Y, region M and region C. A starting position of each region has to be identified before the printing procedure. It is well known for those who are skilled in this art that amber ray transmits through region Y but not region M and region C.

Nevertheless, using only amber ray to identify region Y may result in printing error. While the sensor is located at a spot other than the beginning of region Y, a portion of colorant at region Y and a portion of the sequential colorant at region M are both printed onto the print medium, since colorant is always printed in a fixed area.

Such printing error can be prevented by performing steps 602~604. At step 602, whether amber ray is sensed or not is determined. If amber ray is not sensed, which means the sensor is at region M or region C, the ink sheet is kept forwarding as shown in step 603 and then another determinative step 604 is performed. While amber ray is first sensed after it was not sensed, the sensor is at the beginning of region Y Then, step 605 is performed. On the other hand, if amber ray is sensed at step 602, which means sensor is at anywhere but not necessarily at the beginning of region Y, the ink sheet is kept forwarding as shown in step 601 and then another determinative step 602 is performed. After cyclic determinative steps are performed, the beginning of region Y can be precisely identified.

After region Y is identified, the forwarding of the ink sheet is stopped, as shown in step 605. The colorant or dye at region Y is printed onto a predetermined region of the print medium, preferably by dye-sublimation or wax-transfer, as shown in step 606. Then, the ink sheet is forwarded again, as shown in step 607.

Next, region M is to be identified. It is well known to those who are skilled in the art that amber ray transmits through region Y but not region M. After the identification of region Y, the ink sheet is kept forwarding until amber ray is not sensed. Step 608 is a step determining whether amber ray is sensed or not. If amber ray is sensed, the forwarding of the ink sheet is continued, as shown in step 607. If amber ray is not sensed, which means region M is identified, the forwarding of the ink sheet is stopped, as shown in step 609.

After the identification of region M, the forwarding of the ink sheet is stopped, as shown in step 609. In step 610, colorant or dye at region M is then printed onto the predetermined region of the print medium, preferably by dye-sublimation or wax-transfer. After the printing step, the ink sheet is forwarded again, as shown in step 611.

Then, region C is to be identified. It is well known to those who are skilled in the art that amber ray transmits through none of region M and region C. According to the second example of the invention, a black mark, which is IR ray non-transmittable, is designed at the beginning of region C. In step 612, whether IR ray is sensed or not is determined. If IR ray is sensed, the ink sheet is kept forwarding until IR ray is not sensed. While IR ray is not sensed, region C is identified.

After the identification of region C, the forwarding of the ink sheet is stopped, as shown in step 613. Colorant or dye at the region C is printed onto the print medium preferably by dye-sublimation or wax-transfer, as shown in step 614. After the printing of colorant or dye at region C, the printing procedure of a colorant region set is completed.

The printing procedure according to the second example of the invention is summarized. After region Y is identified, the forwarding of the ink sheet 6 is stopped and the colorant or dye at region Y is printed onto the print medium by the printing head 3. After colorant or dye at region Y is printed, the ink sheet 6 is forwarded again for the identification of region M. After region M is identified, the forwarding of the ink sheet 6 is stopped and the colorant or dye at region M is printed by using the printing head 3 onto the print medium. Then, the ink sheet 6 is forwarded again for the identification of region C. After the identification of region C, the forwarding of the ink sheet 6 is stopped and the colorant or dye at region C is printed onto the print medium by using the printing head 3. Therefore, the printing procedure of one colorant region set, including region Y, region M and region C, is completed.

THE THIRD EXAMPLE

Figure 7:
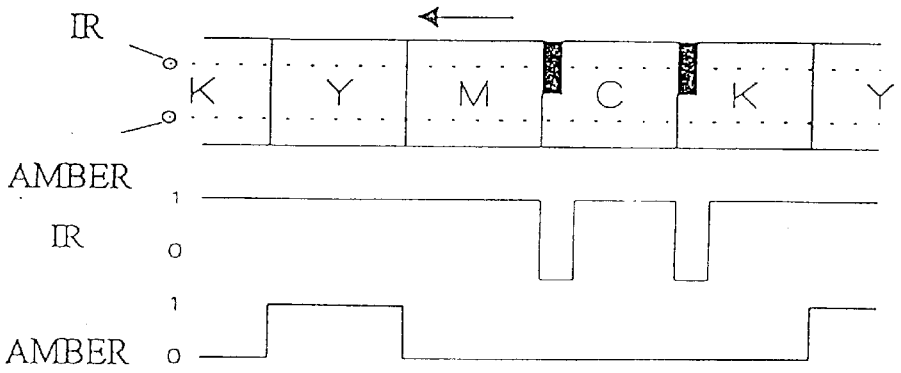
FIG. 7 shows the structure of the ink sheet according to the third example of the invention.

FIG. 7 shows the structure of an ink sheet according to the third example of the invention. In FIG. 7, the arrow indicates the forwarding direction of the ink sheet during the printing procedure. The upper dotted line indicates the location of the IR ray source and the IR ray sensor relative to the ink sheet when the ink sheet is forwarded. The lower dotted line indicates the location of the amber ray source and the amber ray sensor relative to the ink sheet when the ink sheet is forwarded.

As shown in FIG. 7, each colorant region set of the ink sheet according to the third example of the invention includes region Y, region M, region C and region K. The printing order is region Y, region M, region C and region K. In other words, region Y is the first colorant region to be printed, and region K is the last one.

Amber ray and IR ray are applied to identify each colorant region according to the third example of the invention. It is known from Table 1 that amber ray transmits through region Y but not region M, region C and region K. Thus, amber ray can not distinguish region M from region C and region C from region K. According to the third example of the invention, black marks are designed between two adjacent amber ray non-distinguishable regions so that both the beginning of region C and the beginning of region K have black marks. IR ray is herein applied to identify black marks. By using IR ray to identify black mark and also using amber ray to transmit through the colorant regions, four colorant regions can be distinguished from each other. Two relationship lines at the bottom of FIG. 7 respectively represent IR ray transmittance and amber ray transmittance of the colorant region.

The thermal printer of the third example has a structure similar to that of the first example, except that the colorant region set of the ink sheet 6 has region Y, region M, region C and region K.

Figure 8:
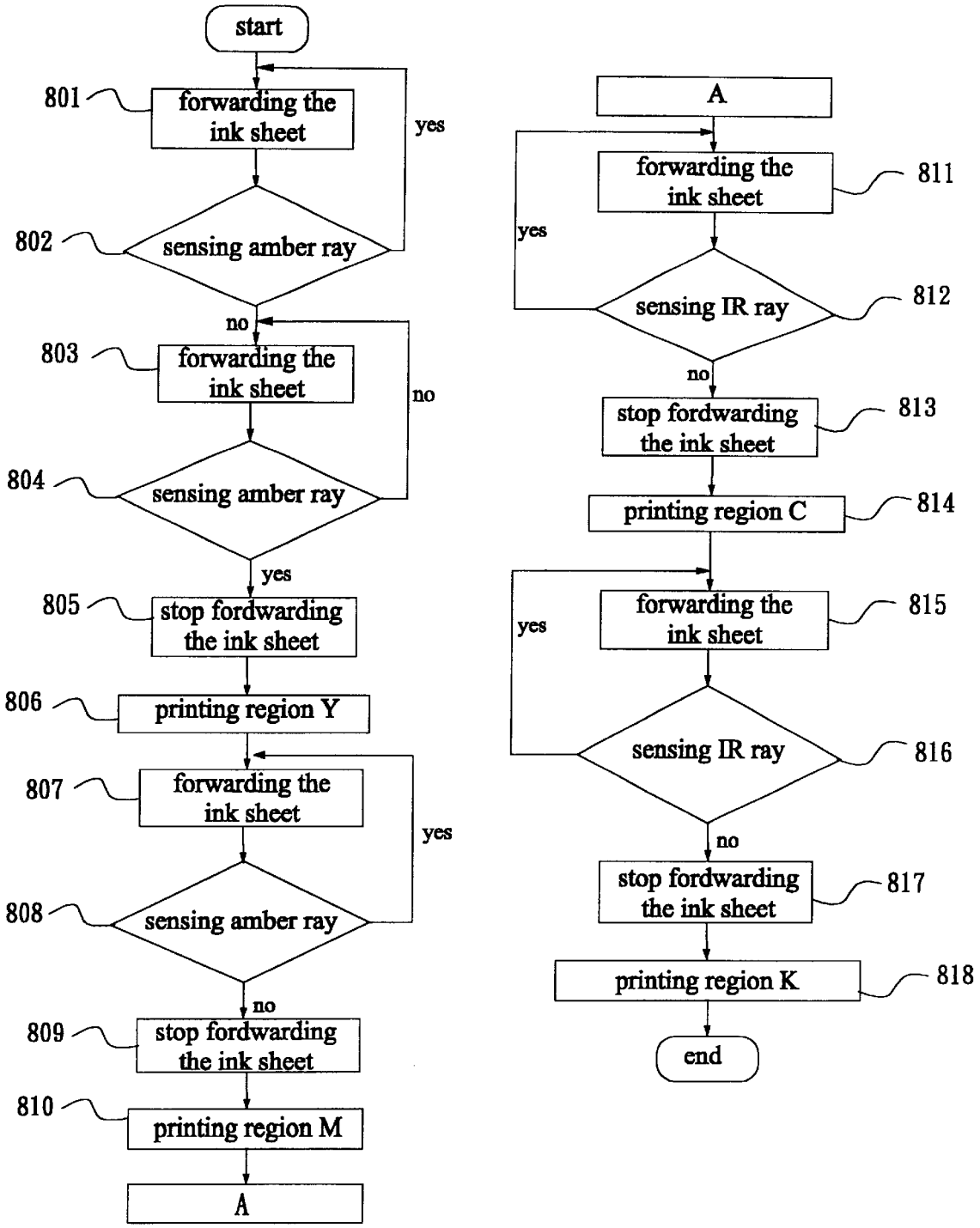
FIG. 8 is a flow chart showing the printing procedure according to the third example of the invention.

The printing procedure of printing one colorant region set having region Y, region M, region C and region K of the third example is shown in FIG. 8.

First, as shown instep 801, the ink sheet is forwarded in a certain direction so that region Y, region M and region C are sequentially passed through the IR sensor and the amber sensor.

At step 802, whether amber ray is sensed or not is determined. If amber ray is not sensed, which means the sensor is at region M or region C, the ink sheet is kept forwarding as shown in step 803 and then another determinative step 804 is performed. While amber ray is first sensed after it was not sensed, the sensor is at the beginning of region Y. Then, step 805 is performed. On the other hand, if amber ray is sensed at step 802, which means sensor is at anywhere but not necessarily at the beginning of region Y, the ink sheet is kept forwarding as shown in step 801 and then another determinative step 802 is performed. After cyclic determinative steps are performed, the beginning of region Y can be precisely identified.

After region Y is identified, the forwarding of the ink sheet is stopped, as shown in step 805. The colorant or dye at region Y is printed onto a predetermined region of the print medium, preferrably by dye-sublimation or wax-transfer, as shown in step 806. Then, the ink sheet is forwarded again, as shown in step 807.

Next, region M is to be identified. It is well known to those who are skilled in the art that amber ray transmits through region Y but not region M. After the identification of region Y, the ink sheet is kept forwarding until amber ray is not sensed. Step 808 is a step determining whether amber ray is sensed or not. If amber ray is sensed, the forwarding of the ink sheet is continued, as shown in step 807. If amber ray is not sensed, which means region M is identified, the forwarding of the ink sheet is stopped, as shown in step 809.

After the identification of region M, the forwarding of the ink sheet is stopped, as shown in step 809. In step 810, colorant or dye at region M is then printed onto the predetermined region of the print medium, preferably by dye-sublimation or wax-transfer. After the printing step, the ink sheet is forwarded again, as shown in step 811.

Then, region C is to be identified. It is well known to those who are skilled in the art that amber ray transmits through none of region M and region C. According to the third example of the invention, one black mark, which is detected by IR ray, is designed at the beginning of region C. In step 812, whether IR ray is sensed or not is determined. If IR ray is sensed, the ink sheet is kept forwarding until IR ray is not sensed, which means region C is identified.

After the identification of region C, the forwarding of the ink sheet is stopped, as shown in step 813. Colorant or dye at the region C is printed onto the print medium preferably by dye-sublimation or wax-transfer, as shown in step 814. After that, the ink sheet is forwarded again, as in step 815.

Then, region K is to be identified. It is well known to those who are skilled in the art that amber ray transmits through none of region C and region K. According to the third example of the invention, another black mark is added at the beginning of region K. In step 816, whether IR ray is sensed or not is determined. If IR ray is sensed, the ink sheet is kept forwarding, as shown in step 815. If IR ray is not sensed, which indicates that region K is identified, the forwarding of the ink sheet is ceased, as shown in step 817.

After the identification of region K, colorant or dye at region K is printed onto the predetermined region of the print medium preferably by ways of dye-sublimation or wax-transfer, as shown in step 818. By now, the printing procedure of a colorant region set according to the third example of the invention is completed.

The printing procedure of the colorant region set according to the third example of the invention is summarized as follows. After the identification of region Y. the forwarding of the ink sheet 6 is stopped and colorant or dye at the colorant region Y is printed onto the print medium. After that, the ink sheet 6 is forwarded again for the identification of region M. After region M is identified, the forwarding of the ink sheet 6 is stopped and the colorant thereof is printed. Then, the ink sheet 6 is forwarded again for the identification of region C. After region C is identified, the ink sheet 6 is stopped and the colorant or dye at the region C is printed onto the print medium. The ink sheet 6 is again forwarded for the identification of region K. After region K is identified, the ink sheet 6 is stopped and the colorant or dye thereof is printed onto the print medium. By now, the printing procedure of the colorant region set having region Y, region M, region C and region K is completed.

In the following examples, the fourth example to the sixth example, blue ray and IR ray are both used for the identification of colorant regions.

THE FOURTH EXAMPLE

Figure 9:
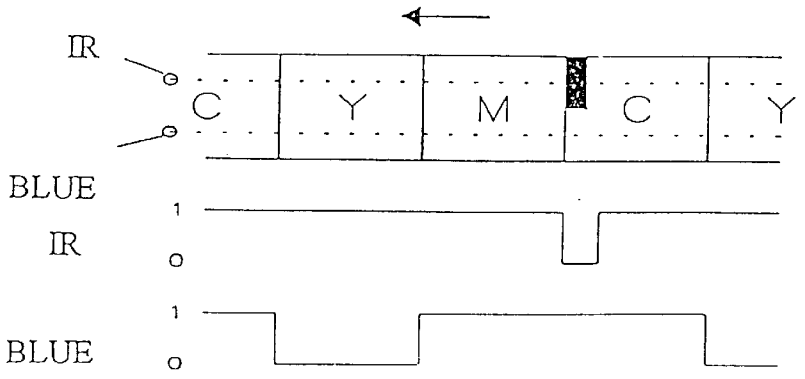
FIG. 9 shows the structure of the ink sheet according to the fourth example of the invention.

The structure of the ink sheet according to the fourth example of the invention is shown in FIG. 9. The arrows indicate the forwarding direction of the ink sheet during the printing procedure. The upper dotted line indicates the location of IR ray source and IR ray sensor relative to the ink sheet. The lower dotted line indicates the location of the blue ray source and the blue ray sensor relative to the ink sheet.

As shown in FIG. 9, each colorant region according to the fourth embodiment of the invention includes region Y, region M and region C. And the printing order is region Y, region M and then region C. In other words, region Y is the first colorant region to be printed and region C is the last colorant region to be printed in a colorant region set.

Blue ray and IR ray are used to identify colorant regions. It is known from Table 1 that blue ray transmits through both regions M and C. That is to say, region M and region C can not be distinguished from each other by only using blue ray. According to the fourth example of the invention, a black mark is designed between region M and region C, i.e. at the beginning of region C. IR ray is again used to identify black marks. According to the blue ray and IR ray transmittance of colorant regions and using black mark as an auxiliary, region Y, region M and region C can be identified. Two relationship lines at the bottom of FIG. 9 respectively represent IR ray and blue ray transmittance of the colorant regions.

The thermal printer according to the fourth example of the invention has a structure similar to the one according to the first example of the invention. Except that the colorant region set thereof includes region Y, region M and region C and the ray source 4*a* and ray sensor 4*b* thereof are blue ray source and blue ray sensor.

Figure 10:
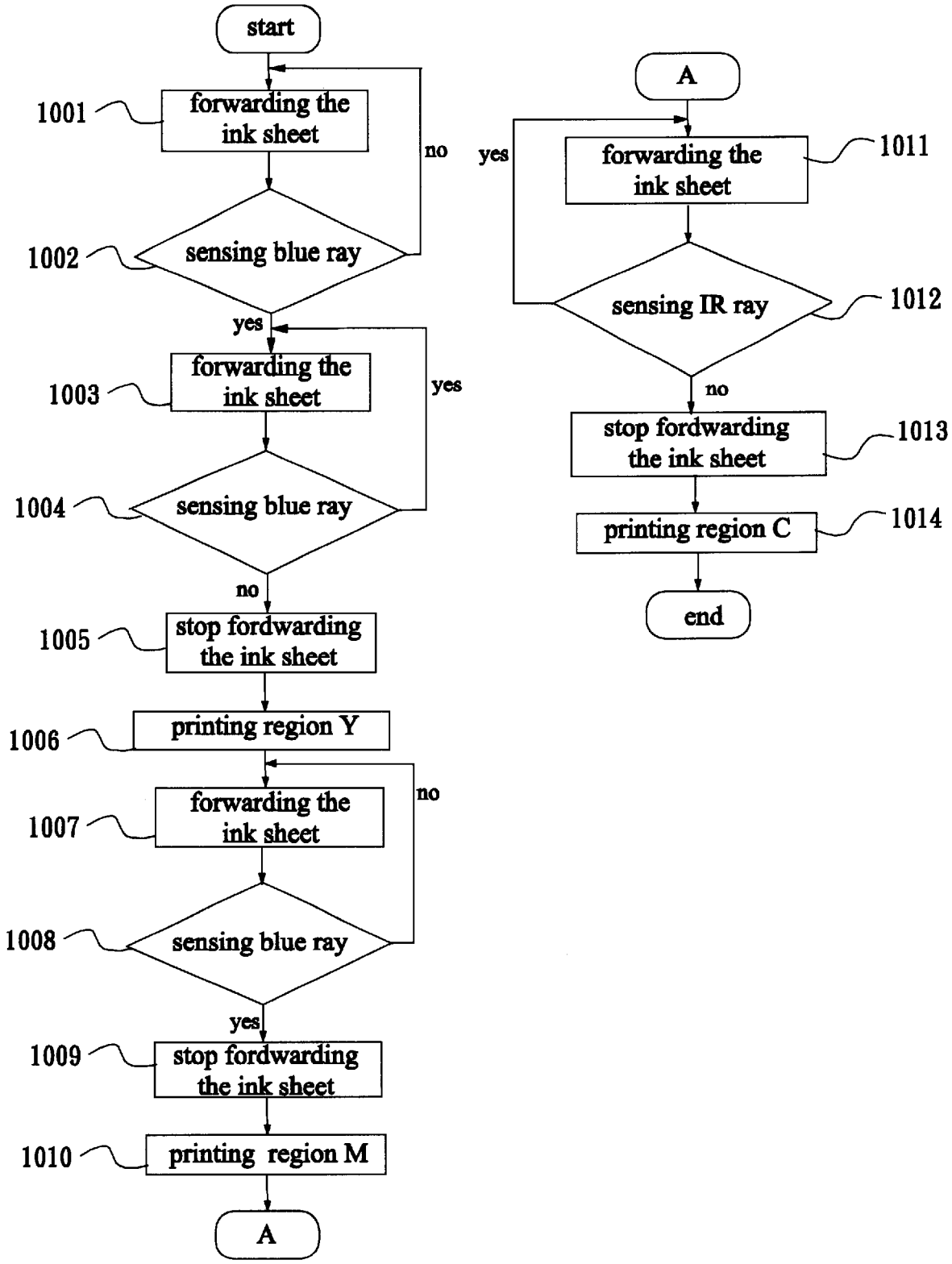
FIG. 10 is a flow chart showing the printing procedure according to the fourth example of the invention.

The printing procedure of printing one colorant region set (region Y, region M and region C) according to the fourth example of the invention is shown in FIG. 10.

First, in step 1001, the ink sheet is forwarded in a certain direction so that region Y, region M and region C are sequentially passed through the IR ray sensor and the blue ray sensor.

At step 1002, whether blue ray is sensed or not is determined. If blue ray is sensed, which means the sensor is at region M or region C, the ink sheet is kept forwarding as shown in step 1003 and then another determinative step 1004 is performed. While blue ray is first hindered after it was sensed, the sensor is at the beginning of region Y. Then, step 1005 is performed. On the other hand, if blue ray is not sensed at step 1002, which means sensor is at anywhere but not necessarily at the beginning of region Y, the ink sheet is kept forwarding as shown in step 1001 and then another determinative step 1002 is performed. After cyclic determinative steps are performed, the beginning of region Y can be precisely identified.

After region Y is identified, the forwarding of the ink sheet is stopped, as shown in step 1005. The colorant or dye at region Y is printed onto a predetermined region of the print medium, preferably by dye-sublimation or wax-transfer, as shown in step 1006. Then, the ink sheet is forwarded again, as shown in step 1007.

Next, region M is to be identified. It is well known to those who are skilled in the art that blue ray transmits through region M but not region Y After the identification of region Y, the ink sheet is kept forwarding until blue ray is sensed. Step 1008 is a step determining whether blue ray is sensed or not. If blue ray is not sensed, the forwarding of the ink sheet is continued, as shown in step 1007. If blue ray is sensed, which means region M is identified, the forwarding of the ink sheet is stopped, as shown in step 1009.

After the identification of region M, the forwarding of the ink sheet is stopped, as shown in step 1009. In step 1010, colorant or dye at region M is then printed onto the predetermined region of the print medium, preferably by dye-sublimation or wax-transfer. After the printing step, the ink sheet is forwarded again, as shown in step 1011.

Then, region C is to be identified. It is well known to those who are skilled in the art that blue ray transmits through both region M and region C. According to the fourth example of the invention, a black mark, which is detected by IR ray, is designed at the beginning of region C. In step 1012, whether IR ray is sensed or not is determined. If IR ray is sensed, the ink sheet is kept forwarding until IR ray is not sensed. While IR ray is not sensed, region C is identified.

After the identification of region C, the forwarding of the ink sheet is stopped, as shown in step 1013. Colorant or dye at the region C is printed onto the print medium preferrably by dye-sublimation or wax-transfer, as shown in step 1014. After the printing of colorant or dye at region C, the printing procedure of a colorant region set is completed.

The printing procedure according to the fourth example of the invention is summarized. After region Y is identified, the forwarding of the ink sheet 6 is stopped and the colorant or dye at region Y is printed onto the print medium by the printing head 3. After colorant or dye at region Y is printed, the ink sheet 6 is forwarded again for the identification of region M. After region M is identified, the forwarding of the ink sheet 6 is stopped and the colorant or dye at region M is printed by using the printing head 3 onto the print medium. Then, the ink sheet is forwarded again for the identification of region C. After the identification of region C, the forwarding of the ink sheet 6 is stopped and the colorant or dye at region C is printed onto the print medium by using the printing head 3. Therefore, the printing procedure of one colorant region set (Y, M and C) is completed.

THE FIFTH EXAMPLE

Figure 11:
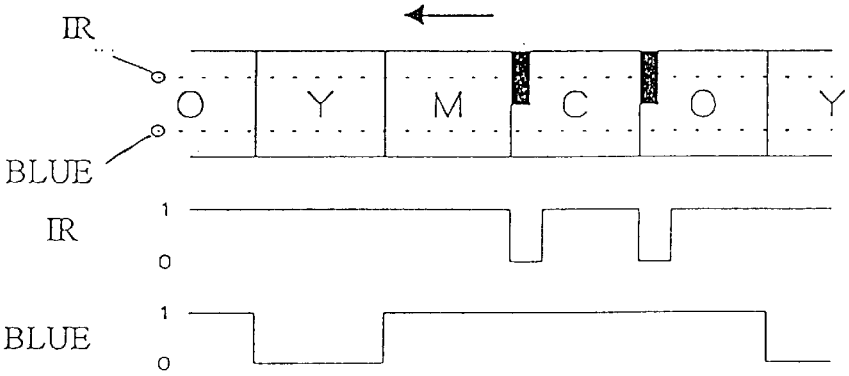
FIG. 11 shows the structure of the ink sheet according to the fifth example of the invention.

The ink sheet according to the fifth example of the invention is shown in FIG. 11. Arrows in the FIG. 11 indicate the forwarding direction of the ink sheet in the printing procedure. The upper dotted line indicates the location of the IR ray source and the IR ray sensor relative to the ink sheet. The lower dotted line indicates the location of the blue ray source and the blue ray sensor relative to the ink sheet.

As shown in FIG. 11, the colorant region set of the ink sheet according to the fifth example of the invention includes region Y, region M, region C and region O. The printing order thereof is region Y, region M, region C and region O. In other words, region Y is the first colorant region to be printed in each colorant region set, and region O is the last one.

Blue ray and IR ray are applied to identify colorant regions according to the fifth example of the invention. From Table 1, it is known that blue ray transmits through region M, region C and region O. Thus, region M and region C can not be distinguished from each other and region C and region O can not be distinguished from each other by only using blue ray.

Therefore, black marks are designed at the beginning of region C and at the beginning of region O as an auxiliary. IR ray herein is used to identify the black marks. According to the IR ray and blue ray transmittance and using black mark as an auxiliary, colorant regions of the fifth example can be identified. Two relationship lines at the bottom of FIG. 11 respectively represent the IR ray transmittance the blue ray transmittance of the colorant regions.

The thermal printer according to the fifth example of the invention has a structure similar to the one according to the first example of the invention. However, the colorant region set of the ink sheet 6 thereof includes region Y, region M, region C and region O. The ray source 4*a* and the ray sensor 4*b* are blue ray source and blue ray sensor.

Figure 12:
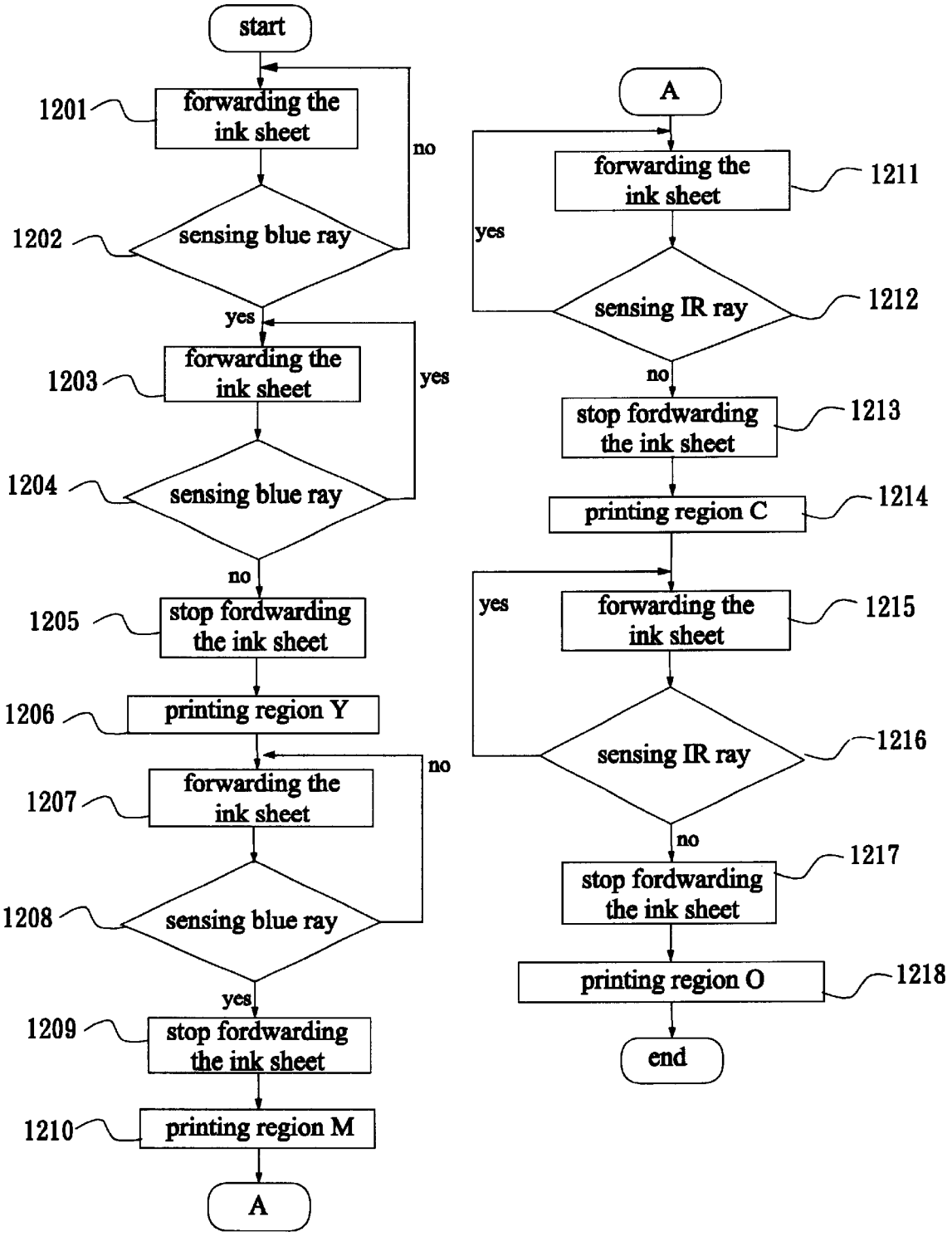
FIG. 12 is a flow chart showing the printing procedure according to the fifth example of the invention.

FIG. 12 is the flow chart showing the printing procedure of printing one colorant region set (region Y, region M, region C and region O) according to the fifth example of the invention.

As shown in step 1201, the ink sheet is forwarded in a direction so that region Y, region M, region C and region O are sequentially passed through the blue ray sensor and the IR ray sensor.

At step 1202, whether blue ray is sensed or not is determined. If blue ray is sensed, which means the sensor is at region M or region C, the ink sheet is kept forwarding as shown in step 1203 and then another determinative step 1204 is performed. While blue ray is first hindered after it was sensed, the sensor is at the beginning of region Y Then, step 1205 is performed. On the other hand, if blue ray is not sensed at step 1202, which means sensor is at anywhere but not necessarily at the beginning of region Y, the ink sheet is kept forwarding as shown in step 1201 and then another determinative step 1202 is performed. After cyclic determinative steps are performed, the beginning of region Y can be precisely identified.

After region Y is identified, the forwarding of the ink sheet is stopped, as shown in step 1205. The colorant or dye at region Y is printed onto a predetermined region of the print medium, preferably by dye-sublimation or wax-transfer, as shown in step 1206. Then, the ink sheet is forwarded again, as shown in step 1207.

Next, region M is to be identified. It is well known to those who are skilled in the art that blue ray transmits through region M but not region Y After the identification of region Y, the ink sheet is kept forwarding until blue ray is sensed. Step 1208 is a step determining whether blue ray is sensed or not. If blue ray is not sensed, the forwarding of the ink sheet is continued, as shown in step 1207. If blue ray is sensed, which means region M is identified, the forwarding of the ink sheet is stopped, as shown in step 1209.

After the identification of region M, the forwarding of the ink sheet is stopped, as shown in step 1209. In step 1210, colorant or dye at region M is then printed onto the predetermined region of the print medium, preferably by dye-sublimation or wax-transfer. After the printing step, the ink sheet is forwarded again, as shown in step 1211.

Then, region C is to be identified. It is well known to those who are skilled in the art that blue ray transmits through both region M and region C. According to the fifth example of the invention, a black mark, which is detected by IR ray, is designed at the beginning of region C. In step 1212, whether IR ray is sensed or not is determined. If IR ray is sensed, the ink sheet is kept forwarding until IR ray is not sensed. While IR ray is not sensed, region C is identified.

After the identification of region C, the forwarding of the ink sheet is stopped, as shown in step 1213. Colorant or dye at the region C is printed onto the print medium preferably by dye-sublimation or wax-transfer, as shown in step 1214.

Then, region O is to be identified. It is well known to those who are skilled in the art that blue ray transmits through both region C and region O. According to the fifth embodiment of the invention, a black mark is designed at the beginning of region O. In step 1216, whether IR ray is sensed or not is determined . If IR ray is sensed, the ink sheet is kept forwarding, as shown in step 1215. If IR ray is not sensed, which means region O is identified, the forwarding of the ink sheet is stopped as shown in step 1217.

After the identification of region O, the colorant or dye thereof is printed onto a certain area of the print medium preferably by ways of dye-sublimation or wax-transfer, as shown in step 1218. By now the printing procedure of the fifth example of the invention is completed.

The printing procedure according to the fifth embodiment of the invention is summarized. After region Y is identified, the forwarding of the ink sheet 6 is ceased and colorant or dye thereof is printed onto the print medium by the printing head. Then, the ink sheet is again forwarded for identifying region M. After region M is identified, the ink sheet 6 is stopped from forwarding and the colorant thereof is printed onto the print medium by the printing head 3. After that, the ink sheet 6 is forwarded again for the identification of region C. After region C is identified, the forwarding of the ink sheet is stopped and the colorant or dye thereof is printed onto the print medium. Next, the ink sheet 6 is forwarded again. Region O is identified while the ink sheet is forwarded. Then, the colorant or dye of region O is printed onto the print medium. By now, the printing procedure of printing a colorant region set (region Y, region M, region C and region O) according to the fifth example is completed.

THE SIXTH EXAMPLE

Figure 13:
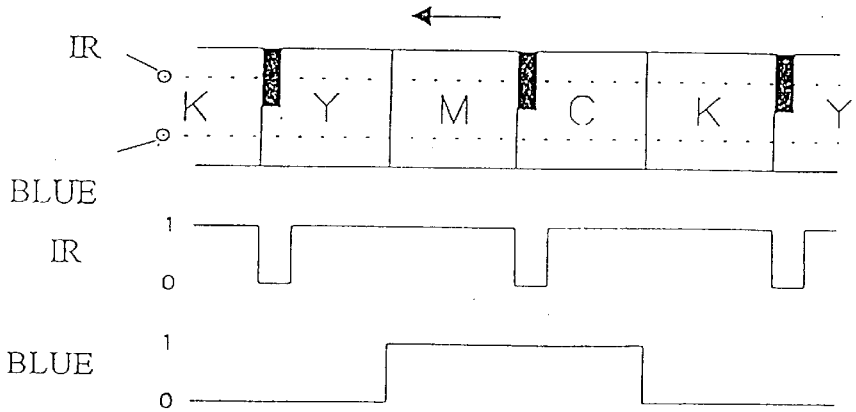
FIG. 13 shows the structure of the ink sheet according to the sixth example of the invention.

The ink sheet according to the sixth example of the invention is shown FIG. 13. Arrows indicate the forwarding direction of the ink sheet during the printing procedure. The upper dotted line indicates the location of the IR ray source and the IR ray sensor relative to the ink sheet while the ink sheet is forwarded. The lower dotted line indicates the location of the blue ray source and the blue ray sensor relative to the ink sheet while the ink sheet is forwarded.

Each colorant region set of the ink sheet according to the sixth example in FIG. 13 includes region Y, region M, region C and region K and the printing order is region Y, region M, region C and region K. In other words, region Y is the first colorant region to be printed and region K is the last one.

Blue ray and IR ray are applied to identify the colorant regions according to the sixth example of the invention. From Table 1, it is known that blue ray transmits through region M and region C but not region Y and region K. Thus, region Y and region K are not distinguishable and also region M and region C are not distinguishable by using only blue ray. So black marks are designed at the beginning of region Y and region C as auxiliary and IR ray is used to identify the black mark. According to the blue ray and IR ray transmittance, the colorant regions can be identified. Two relationship lines at the bottom of FIG. 13 respectively represent the blue ray and IR ray transmittance of the colorant regions.

The thermal printer according to the sixth example of the invention has a structure similar to the one according to the first example. Except that the colorant region set of the ink sheet 6 has region Y, region M, region C and region K. The ray source 4*a* and the ray sensor 4*b* herein are blue ray source and blue ray sensor.

Figure 14:
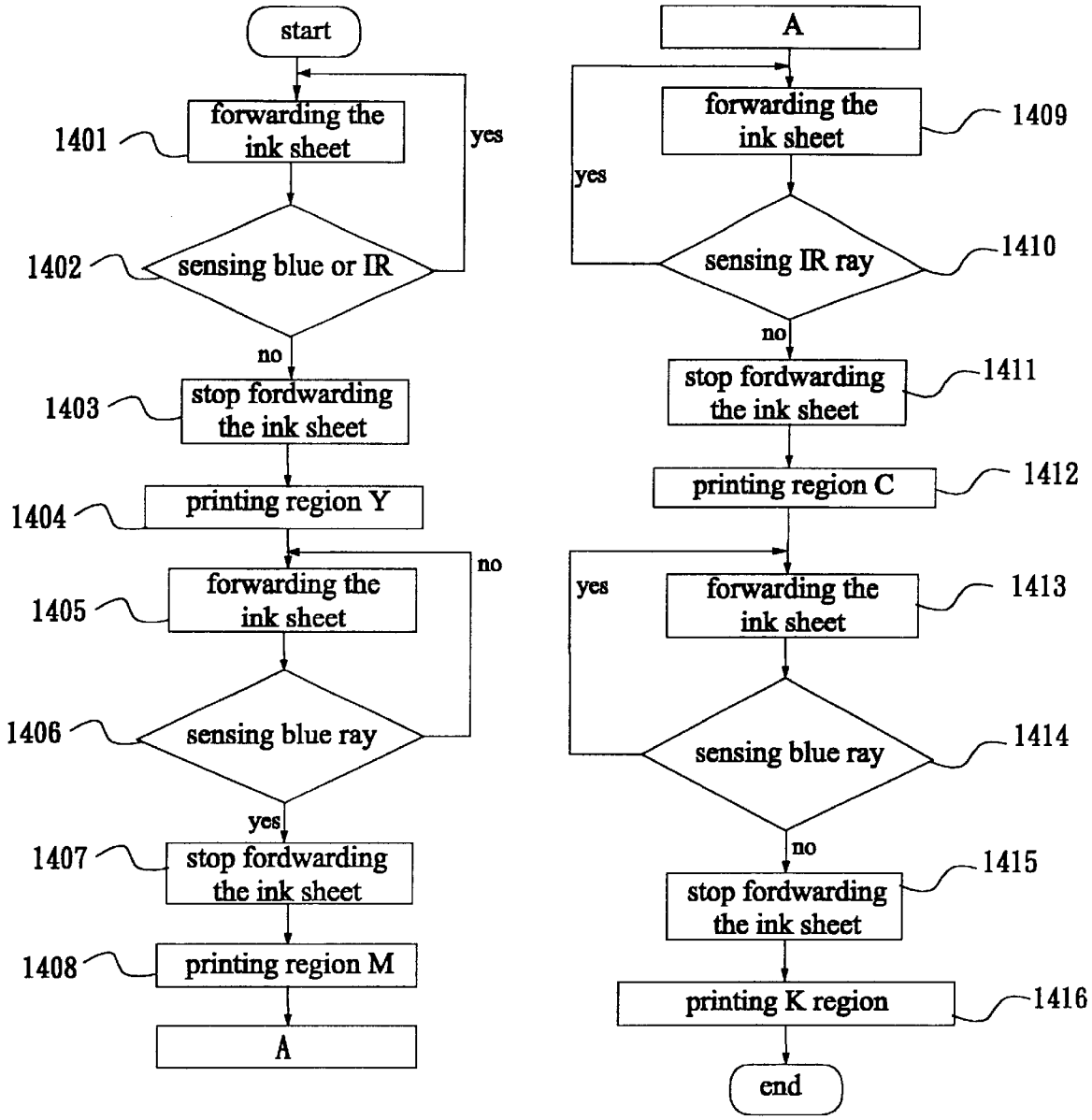
FIG. 14 is a flow chart showing the printing procedure according to the sixth example of the invention.

FIG. 14 is the flow chart showing the printing procedure of printing one colorant region set, including region Y, region M, region C and region K, according to the sixth example of the invention.

First, as shown in step 1401, the ink sheet is forwarded in a certain direction so that region Y, region M, region C and region K are sequentially passed through the IR ray sensor and the blue ray sensor.

Then, a starting region Y is to be identified. As shown in FIG. 13, a black mark is designed at the beginning of region Y. In step 1402, it is determined whether blue ray or IR ray is sensed or not. The ink sheet is forwarded until none of blue ray and IR ray is sensed. While none of blue ray and IR ray is sensed, which means region Y is identified, step 1403 is performed.

In step 1403, the ink sheet is stopped from forwarding. Colorant or dye at region Y is printed onto the predetermined area of the print medium preferrably by ways of dye-sublimation or wax-transfer, as shown in step 1404. Then, the ink sheet is forwarded again as shown in step 1405.

In the following, region M is to be identified. It is well known to those who are skilled in the art that blue ray transmits through region M but not region Y. After the identification of region Y, the ink sheet is forwarded until blue ray is sensed. Step 1406 is the step determining whether blue ray is sensed or not. If blue ray is sensed after not being sensed for a short period, region M is identified.

After region M is identified, ink sheet is stopped from forwarding, as shown in step 1407. Colorant or dye at region M is printed onto the predetermined area of the print medium preferably by ways of dye-sublimation or wax-transfer, as shown in step 1408. Then, the ink sheet is forwarded again, as shown in step 1409.

Then, region C is to be identified. It is well known to those who are skilled in the art that blue ray transmits through both region M and region C. Therefore, region M and region C can not be distinguished from each other by only using blue ray. According to the sixth example of the invention, another black mark is designed at the beginning of the region C. Thus, region C can be identified by using the black mark as an auxiliary. In step 1410, whether IR ray is sensed or not is determined. The non-sensing of IR ray represents the identification of region C. If IR ray is sensed, the ink sheet is kept forwarding as shown in step 1409. If IR ray is not sensed, the forwarding of the ink sheet is ceased as shown in step 1411. And then, in step 1412, colorant or dye thereof is printed onto the predetermined area of the print medium preferably by ways of dye-sublimation or wax-transfer. Then, in step 1413, the ink sheet is forwarded again.

Next, region K is to be identified. It is well known to those who are skilled in the art that blue ray transmits through region C but not region K. In step 1414, whether blue ray is sensed or not is determined. If blue ray is sensed, the ink sheet is kept forwarding as shown in step 1413. If blue ray is not sensed, which indicates that region K is identified, the forwarding of the ink sheet is stopped, as shown in step 1415.

After that, colorant or dye at region K is printed onto a certain area of the print medium preferably by ways of dye-sublimation or wax-transfer, as shown in step 1416. By now the printing procedure of printing a colorant region set according to the sixth example of the invention is completed.

The printing procedure according to the sixth example of the invention is summarized as follows. After the identification of region Y, the ink sheet 6 is stopped from forwarding and the colorant or dye thereof is printed onto the print medium, using the printing head 3. Then, the ink sheet 6 is forwarded again for the identification of region M. After region M is identified, the ink sheet 6 is ceased and the colorant or dye thereof is printed onto the print medium by the printing head 3. Then, region C is to be identified. After region C is identified, the ink sheet 6 is stopped from forwarding, and colorant or dye thereof is printed onto the print medium. Next, the ink sheet is forwarded again for the identification of region K. After region K is identified, the ink sheet is stopped from forwarding and the colorant or dye thereof is printed onto the print medium. By now, the printing procedure according to the sixth example of the invention is completed.

According to the spirit of the invention, colorant regions are identified substantially by combining IR ray with amber ray or blue ray. The colorant region set of the ink sheet can consist of regions Y, M, and C, the combination of regions Y, M, C and/or O, or the combination of regions Y, M, C and/or K. While two adjacent regions are amber ray or blue ray non-distinguishable, for example, both are amber/blue ray transmittable or both are amber/blue ray non-transmittable, an auxiliary black mark is designed at the beginning of the second region. The auxiliary black mark is amber ray and blue ray non-transmittable and can be identified by IR ray. No transparent region between any two adjacent colorant regions is needed according to the spirit of the invention. Thus, the length of the ink sheet can be reduced and the cost thereof is cut down.

While the invention has been described by way of example and in terms of a preferred example, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A thermal printer, comprising:

an ink sheet, comprising a plurality of sets of colorant regions, each set of colorant regions comprising a first colorant region, a second colorant region, a third colorant region, a fourth colorant region, each colorant region having a front edge and a rear edge, a first mark formed at the front edge of the third colorant region, and a second mark formed at the front edge of the first colorant region;

a first light source for emitting a first light toward the ink sheet, the first light being able to pass through the first colorant region and the fourth colorant region with a first level energy, and pass through the second and third colorant regions with a second level energy;

a second light source for emitting a second light toward the ink sheet, the second light being able to pass through the first, second, third and fourth colorant regions with a third level energy, and pass through the first mark and the second mark with a fourth level energy;

a first sensor generating a first signal when detecting the first level energy of the first light passing through the ink sheet;

a second sensor generating a second signal when detecting the fourth level energy of the second light passing through the ink sheet; and a forwarding device, for forwarding the ink sheet to perform a movement relative to the first and second light sources;

wherein which colorant region is positioned adjacent to the first and second light sources is determined by a combination of the first and second signals;

wherein the first, second, third and fourth colorant regions are substantially as wide as the ink sheet, and the front edge of the first colorant region is completely adjacent to the rear edge of the fourth colorant region, and the rear edge of the first colorant region is completely adjacent to the front edge of the second colorant region, wherein the second light source is an infrared red light source and the second sensor is an infrared light sensor, wherein the first and second marks are substantially infrared light non-transmissable, wherein the first light source is an amber light source and the first sensor is an amber light sensor, and wherein the second and third colorant regions of each set of colorant regions are substantially amber light non-transmissable.

2. A thermal printer according to claim 1, wherein the four colorant regions of each set of colorant regions comprise a sequential arrangement of yellow colorant, magenta colorant, cyan colorant and an overlay region.

3. A thermal printer, comprising:

an ink sheet, comprising a plurality of sets of colorant regions, each set of colorant regions comprising a first colorant region, a second colorant region, a third colorant region, each colorant region having a front edge and a rear edge, and a first mark formed at the front edge of the third colorant region;

a first light source for emitting a first light toward the ink sheet, the first light being able to pass through the first colorant region with a first level energy, and pass through the second, and third colorant regions with a second level energy;

a second light source for emitting a second light toward the ink sheet, the second light being able to pass through the first, second, and third colorant regions with a third level energy, and pass through the first mark with a fourth level energy;

a first sensor generating a first signal when detecting the first level energy of the first light passing through the ink sheet;

a second sensor generating a second signal when detecting the fourth level energy of the second light passing through the ink sheet; and a forwarding device, for forwarding the ink sheet to perform a movement relative to the first and second light sources;

wherein which colorant region is positioned adjacent to the first and second light sources is determined by a combination of the first and second signals;

wherein the first, second, and third colorant regions are substantially as wide as the ink sheet, and the front edge of the first colorant region is completely adjacent to the rear edge of the third colorant region, and the rear edge of the first colorant region is completely adjacent to the front edge of the second colorant region, wherein the second light source is an infrared red light source and the second sensor is an infrared light sensor, wherein the first mark is substantially infrared light non-transmissable, wherein the first light source is an amber light source and the first sensor is an amber light sensor, and wherein the second and third colorant regions of each set of color and regions are substantially amber light non-transmissable.

4. A thermal printer according to claim 3, wherein the three colorant regions of each set of colorant regions comprise a sequential arrangement of yellow colorant, magenta colorant, and cyan colorant.

5. A thermal printer, comprising:

an ink sheet, comprising a plurality of sets of colorant regions, each set of colorant regions comprising a first colorant region, a second colorant region, a third colorant region, a fourth colorant region, each colorant region having a front edge and a rear edge, a first mark formed at the front edge of the third colorant region, and a second mark formed at the front edge the fourth colorant region;

a first light source for emitting a first light toward the ink sheet, the first light being able to pass through the first colorant region with a first level energy, but pass through the second, third and fourth colorant regions with a second level energy;

a second light source for emitting a second light toward the ink sheet, the second light being able to pass through the first, second, third and fourth colorant regions with a third level energy, and pass through the first mark and second mark with a fourth level energy;

a first sensor generating a first signal when detecting the first level energy of the first light passing through the ink sheet;

a second sensor generating a second signal when detecting the fourth level energy of the second light passing through the ink sheet; and a forwarding device, for forwarding the ink sheet to perform a movement relative to the first and second light sources;

wherein which colorant region is positioned adjacent to the first and second light sources is determined by a combination of the first and second signals;

wherein the first, second, third and fourth colorant regions being substantially as wide as the ink sheet, and the front edge of the first colorant region is completely adjacent to the rear edge of the fourth colorant region, and the rear edge of the first colorant region is completely adjacent to the front edge of the second colorant region, wherein the second light source is an infrared red light source and the second sensor is an infrared light sensor, wherein the first and second marks are substantially infrared light non-transmissable, wherein the first light source is an amber light source and the first sensor is an amber light sensor, and wherein the second, third and fourth colorant regions of each set of colorant regions are substantially amber light non-transmissable.

6. A thermal printer according to claim 5, wherein the four colorant regions of each set of colorant regions comprise a sequential arrangement of yellow colorant, magenta colorant, cyan colorant and a black region.

* * * * *

UNITED STATES PATENT AND TRADEMARK OFFICE

CERTIFICATE OF CORRECTION

PATENT NO. : 6,504,561 B1
DATED : January 7, 2003
INVENTOR(S) : Yih

It is certified that error appears in the above-identified patent and that said Letters Patent is hereby corrected as shown below:

Title page,
Item [73], Assignee, change "Acer Communications and Multimedia, Inc., Yaoyuan (TW)" to -- BENQ Corporation, Taoyuan (TW) --

Signed and Sealed this

Twenty-second Day of February, 2005

JON W. DUDAS
*Director of the United States Patent and Trademark Office*